United States Patent [19]

Bowles

[11] Patent Number: 4,705,157

[45] Date of Patent: Nov. 10, 1987

[54] ARTICLE TURNING ASSEMBLY

[75] Inventor: Myron A. Bowles, Waukegan, Ill.

[73] Assignee: Bell & Howell Company, Chicago, Ill.

[21] Appl. No.: 872,296

[22] Filed: Jun. 9, 1986

[51] Int. Cl.[4] ..... B65G 15/00

[52] U.S. Cl. ..... 198/405; 198/412

[58] Field of Search ..... 198/412, 405

[56] References Cited

U.S. PATENT DOCUMENTS 2,947,406 8/1960 Hazelton ..... 198/405

3,685,471 8/1972 Reynolds ..... 198/412 X

FOREIGN PATENT DOCUMENTS 1234629 12/1964 Fed. Rep. of Germany ..... 198/405

*Primary Examiner*—Richard J. Scanlan, Jr.

*Attorney, Agent, or Firm*—Alan H. Haggard; Alan B. Samlan

[57] ABSTRACT

A device for turning articles such as envelopes 90 degrees as the articles are moved forward from an entrace location to an exit location. Two flexible endless belts, each having a span contiguous to a corresponding span of the other, move the articles as they are turned. A pair of entrance and exit rollers have the flexible belts wrapped around them. The axis of each of the entrance rollers is horizontally disposed and the axis of each of the exit rollers is turned 90 degrees in the direction of the angular displacement of the article such that the axis of each of the exit rollers is disposed vertically. A pair of idler rollers assist in keeping the belts properly positioned on the entrance and exit rollers.

20 Claims, 6 Drawing Figures

ARTICLE TURNING ASSEMBLY

BACKGROUND AND SUMMARY OF THE INVENTION

This invention relates to mass-mail handling equipment and more particularly to a device for turning envelopes from a flat, horizontal position to a vertical position on one of its edges.

Mass-mailing equipment has become very diverse in its functions. For instance, inserting equipment transports envelopes along an inserting track while various types of inserts are automatically inserted into the envelopes. The envelopes are normally transported to another piece of equipment that automatically seals the envelopes, weighs them and affixes postage. Still additional equipment can automatically read the zip codes or zip code indicia on the envelopes and indicate zip code breaks in the envelope groups for zip code presorting. This allows the user to take advantage of lower postal rates. Other mass-mailing equipment may include remittance processing equipment and zip code sorting equipment.

Customers utilizing mass-mailing equipment may have differing needs and requirements. Therefore, mass-mailing equipment is generally designed for one specific function. Each piece can then be connected by conveyor or other transport means to additional mail processing equipment so a customized system can be assembled. One problem with this approach is that adjacent mail processing equipment may require the envelopes to be oriented in a position which is different than the discharge of the proceeding piece of equipment. This necessitates transition conveyors or re-orientation devices.

For example, most inserting equipment in use today moves the envelopes along a track with their faces (the addresses) face down and the flaps extended with the back of the flaps up during the insertion mode. The envelopes, as they leave the inserting machine, may have the flaps moistened and sealed before exiting the inserter. If the envelope is then going to have postage applied, it must be turned over 180 degrees so that the postage can be affixed to the face of the envelope. One such device suitable for turning the envelopes over is disclosed in U.S. Pat. No. 4,226,324, entitled "Article Turnover Assembly" and assigned to the applicant of the present invention. A problem with the device illustrated in the '324 patent is that it turns the envelopes over 180 degrees and it is not adaptable to turn the envelopes over only 90 degrees. This same problem is found in other prior art devices.

An object of the inventive device is to provide an apparatus that can turn envelopes 90 degrees at high speeds without the envelopes being dropped from the turning device or jamming within the device.

It is a further object to turn the articles while they are being transported along the path of travel of the envelopes.

A further object of this invention is to provide a turning device which requires a relatively short travel distance from its entrance to its exit while the envelopes are being turned.

Still another object is to provide an envelope turning device which does not require adjustments to accommodate various thicknesses of envelopes.

It is also an object of the invention to provide a turning device which maintains the articles in proper registration and alignment for further processing in a mass-mailing system.

The present article turning device transports flat articles such as envelopes or documents from its entrance location which is properly aligned to receive envelopes from mail processing equipment such as an envelope inserter. The entrance location has a nip formed by upper and lower spherical rollers. The spherical rollers are offset with respect to each other to begin turning the envelope as soon as it enters the nip. At an exit location is a pair of exit rollers which have their axes rotated 90 degrees with respect to the axes of the entrance rollers. Two flexible endless belts are wrapped around the entrance and exit rollers. The flexible endless belts transport and turn the envelopes between them as the belts are moved from the entrance location to the exit location. The belts are twisted 90 degrees between the entrance and exit rollers, and each belt has at least one span which is contiguous to a corresponding span of the other belt.

There is a motor or other suitable driving means for driving at least one of the rollers so that the belts and rollers move together. There also are a pair of idler rollers with one of the idler rollers contacting each of the endless belts to assist in maintaining the belts in proper position around the entrance and exit rollers. The entrance and exit rollers are spherically configured or crowned to keep the endless flexible belts positioned on the rollers.

BRIEF DESCRIPTION OF THE DRAWINGS

The foregoing and other objects, features and advantages of the invention will be apparent from the following more specific description of the preferred embodiment as illustrated in the accompanying drawings.

DESCRIPTION OF THE PREFERRED EMBODIMENT

Figure 1:
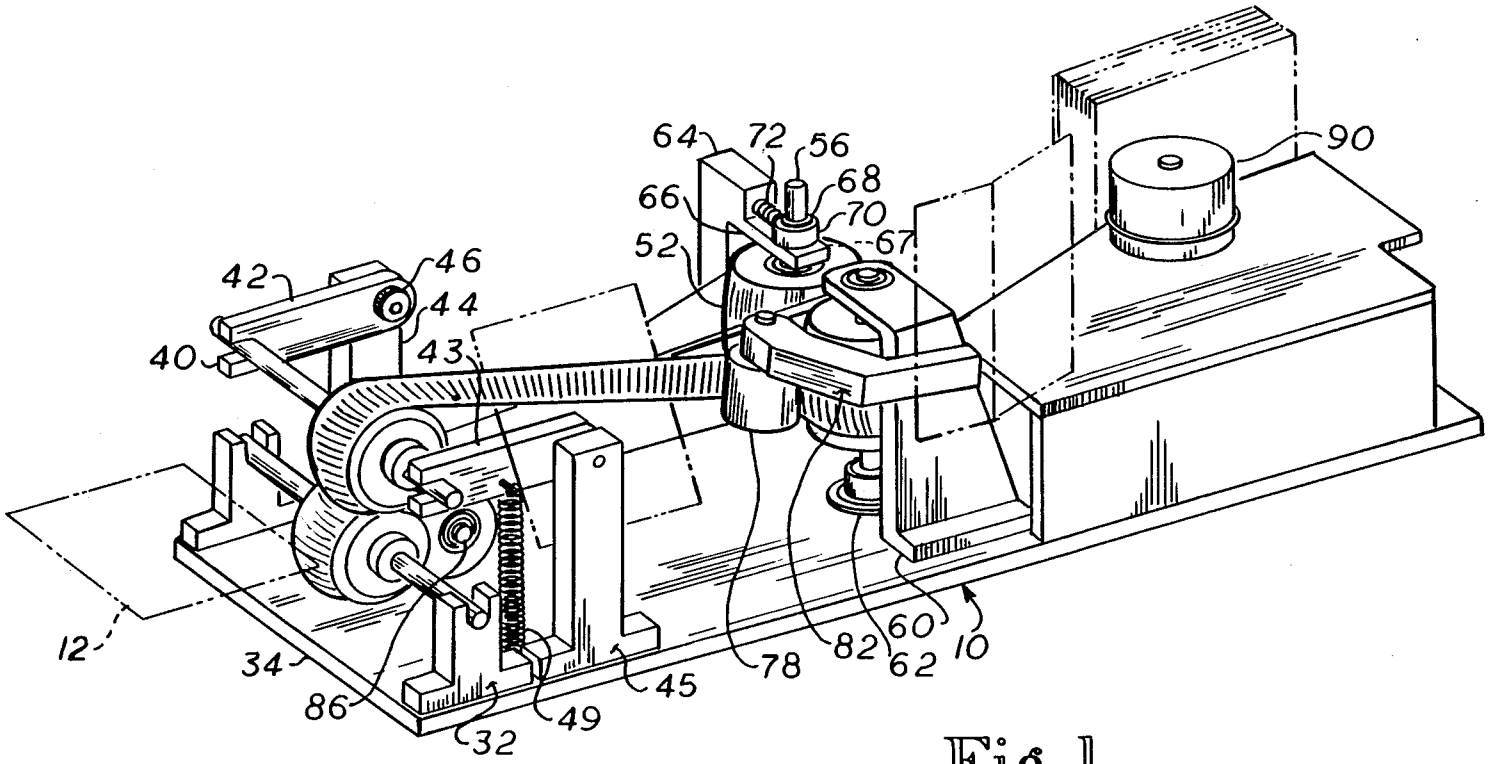
FIG. 1 is a perspective view from the entrance end of the turning device illustrating the path of an article as it is transported through the device.
Figure 2:
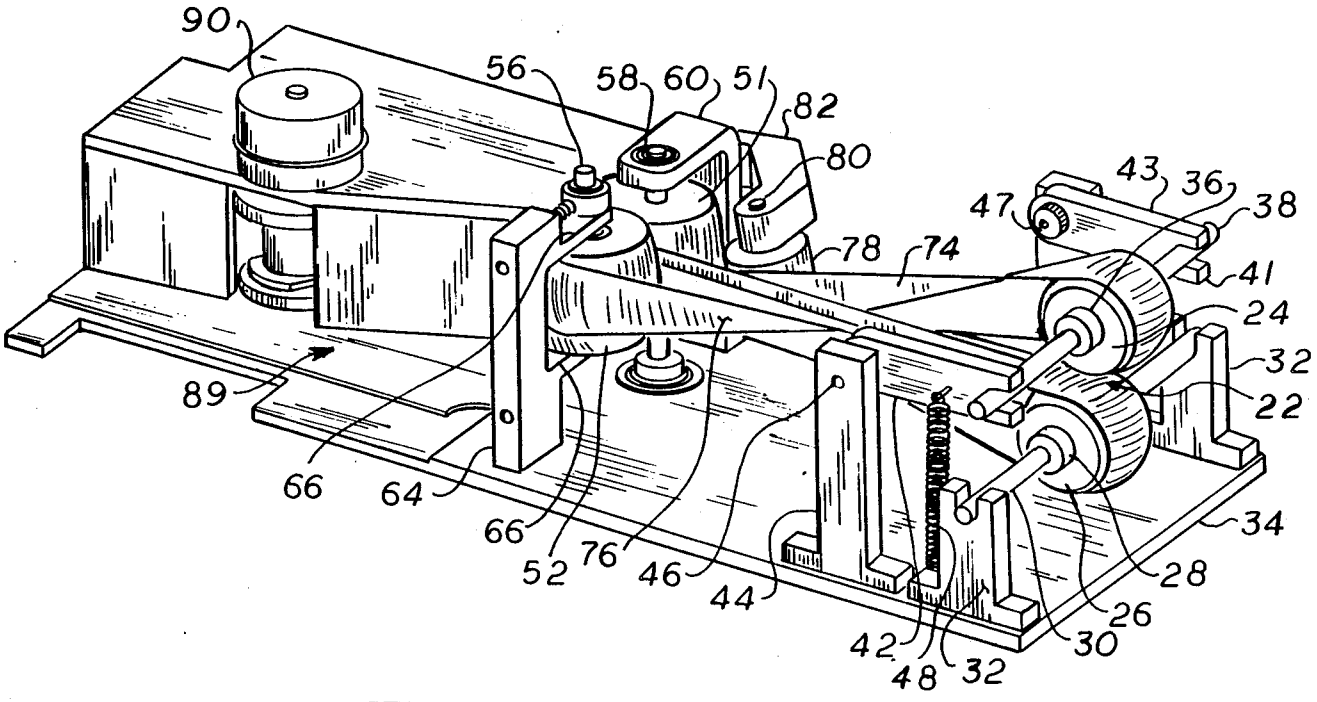
FIG. 2 is a perspective view of the device from the entrance end and from the opposite side of the device shown in FIG. 1.

Turning first to FIGS. 1 and 2, there is illustrated an article turning device 10 of the present invention. Envelopes 12 are received from an inserter or other suitable mail processing equipment (not illustrated) onto a transition registration plate 14 (best illustrated in FIG. 3). There is a fixed registration guide 16 against which one edge of the envelope 12 is registered. An adjustable registration guide 18 is at the opposite end of the fixed registration guide 16 and can be adjusted by means of knobs 20 to slide in the direction of arrow A-B. This permits the adjustable registration guide 18 to be adjusted to the overall height of the envelope 12. The envelopes 12 are discharged from the inserter with sufficient force to propel them into an entrance nip 22 which is best seen in FIGS. 1 and 2. The entrance nip is defined by an upper entrance roller 24 and a lower entrance roller 26 both of which are spherical or crowned rollers.

The lower entrance roller 26 is mounted on a bearing 28 which has a lower shaft 30 passing through it. The lower shaft 30 is supported at each of its ends on support brackets 32 which are mounted on a base plate 34. Thus, it can be seen that the lower shaft 30 is maintained at a fixed height.

The upper entrance roller 24 is mounted on a bearing 36 which has an upper shaft 38 passing through it. The ends of the upper shaft 38 are retained in yoke assemblies 40, 41 at one end of linking arms 42, 43, respectively. The opposite ends of the linking arms 42, 43 are mounted to support arms 44, 45 by means of pivot pins 46, 47. Two tension springs 48, 49 have one end connected approximately at the mid point of the linking arm 42 or 43 and its other end fastened to the base plate 34. Thus it can be seen that the linking arms 42 and 43 are pulled down towards the base plate 34. This maintains a compressive force between the upper and lower rollers 24, 26.

Figure 3:
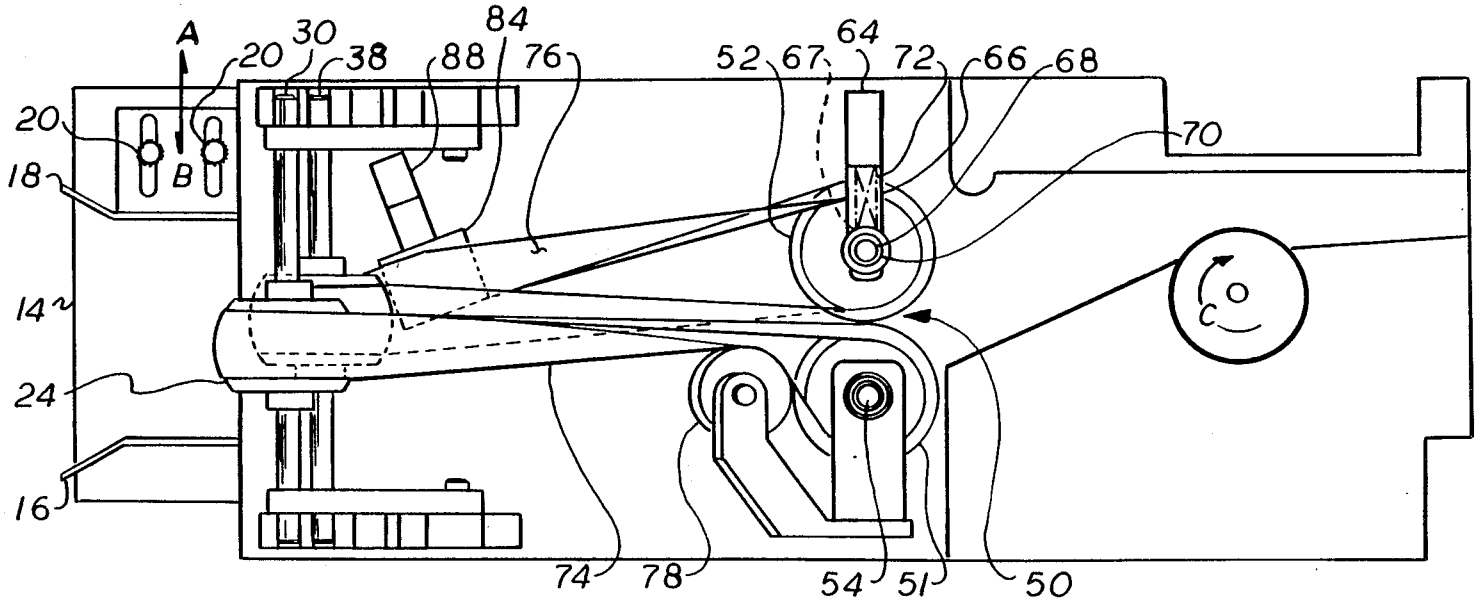
FIG. 3 is a top view of the turning device.
Figure 4:
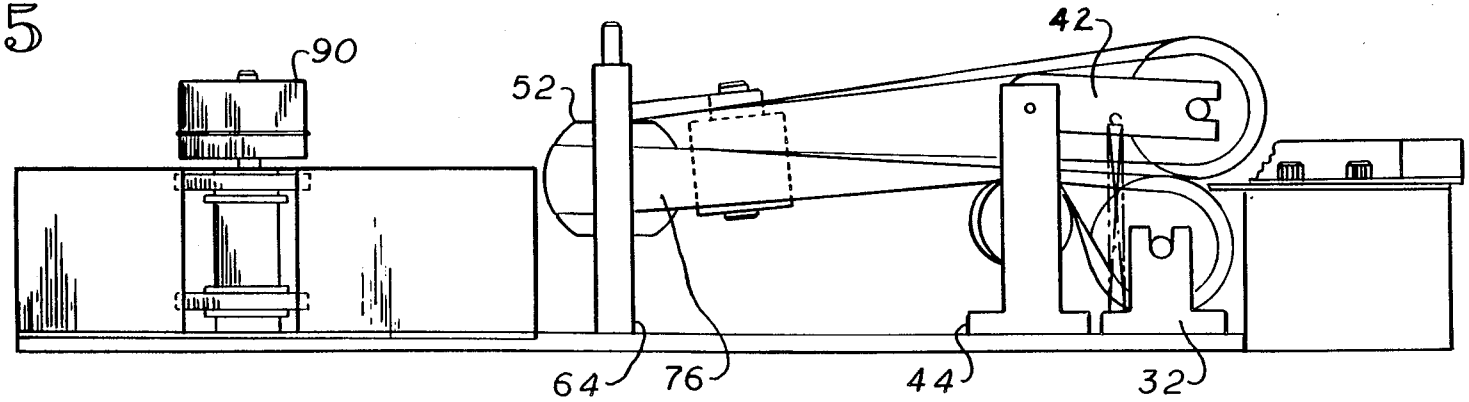
FIG. 4 is a side view with portions removed of the device of FIG. 2.

An exit nip 50 (FIG. 3) is formed at the end of the discharge end of the device 10. The exit nip 50 is defined by a first and second exit rollers 51 and 52. The first exit roller 51 and second exit roller 52 are mounted on respective vertical shafts 54 and 56. One end of shaft 54 is mounted in a bearing 58 at the top of an upstanding bracket 60. The other end of the shaft 54 passes through a bearing 62 and extends below the base plate 34. The lower end of the shaft 54 is driven by suitable drive means such as an electric motor, which is not illustrated. In FIG. 3 it can be seen that the long axis of shaft 54 is mounted on one side of a vertical plane that bisects roller 26 and is perpendicular to shaft 30 and that the long axis of shaft 56 is on the other side of this vertical plane.

The vertical shaft 56 is mounted in a bracket 64 which has its base attached to the base plate 34. There are two arms 66 that extend horizontally from the bracket 64. The horizontal arms 66 have an elongated groove 67 (not visible) cut in each of the arms 66. The shaft 56 passes through the groove and is mounted at its top end in a bearing 68 and collar 70 assembly. Although not visible in the Figures, the lower end of the shaft 56 has a similar mounting arrangement in the lower arm 66. A spring 72 has one end pushing against the bracket 64 and its other end against the collar 70. This pushes the shaft 56 and its associated roller 52 towards the first exit roller 50 which tends to keep the rollers in contact except when an envelope 12 passes therebetween. At this time the spring 72 will compress and allow the second exit roller 52 to slide within the groove 67 and separate from the first roller 50.

Passing around the upper entrance roller 24 and first exit roller 51 is a drive belt 74. The belt 74 is twisted 90 degrees from the entrance roller 24 to the exit roller 50. The belt is a flexible elastic endless belt which is stretched around the upper entrance roller 24 and first exit roller 50 so that it is snugly wrapped around both rollers. Similarly, the lower entrance roller 26 and second exit roller 52 have a driven belt 76 wrapped around them. This belt is also twisted 90 degrees from the entrance to the exit. The belts are twisted in the direction of the angular displacement of the envelope as it moves through the article turning device 10.

A portion of each of the belts 74, 76 are in contact with each other from the entrance nip 22 to the exit nip 50. This portion where the belts are in contact and contiguous with each other is the area through which the envelopes 12 are transported and turned. In this regard, it can be seen that there is a first idler roller 78 mounted adjacent to exit roller 51 on a shaft 80 which in turn is mounted to an arm 82. The arm 82 is fastened to the bracket 60. The idler roller 78 has a flat roller surface which contacts one side of the drive belt 74 and biases it towards the other side of itself as the belt returns from being wrapped around the exit roller 51. The purpose of the idler roller 78 is to assist in maintaining the drive belt 74 in its proper position around the first exit roller 51 such that the drive belt 74 will not move up or down on the surface of the exit roller 51. If the idler roller 78 was not utilized, the belt 74 would tend to "walk" up along the surface of the roller 51 and eventually slide off the top of the exit roller 51.

In FIGS. 1 and 3 it is seen that there is a second idler roller 84 mounted adjacent to entrance roller 26 on a shaft 86 which in turn is affixed to a mounting bracket 88. The shaft 86 forms an acute angle with the axis of the shaft 38. The second idler roller 84 biases the outside portion of the belt 76 towards the contiguous portion of itself as the belt 76 returns from being wrapped around the entrance roller 26. In a manner similar to idler roller 78, the second idler roller 84 assists in maintaining the drive belt 76 positioned on the lower entrance roller 26 such that the drive belt 76 will not slide off the roller 26.

In practice it was found that spherical rollers having a diameter of $1\frac{1}{4}$ inches were satisfactory to maintain the flexible belts in proper position on the entrance rollers 24 and 26. The exit rollers satisfactorily kept the belts seated thereon when spherical rollers having a 4 inch diameter were used. However crowned rollers are interchangeable and will also satisfactorily operate in this device. The important point is that the rollers 24, 26, 51 and 52 all have a raised center on which the belts can properly seat and stay aligned with the aid of the idler rollers 78 and 84. Utilizing the inventive turning device 10 as described above, applicant has been able to successfully operate and turn envelopes in as little as 12 inches from the entrance to the exit nip.

The operation of the article turning device is relatively simple. An envelope 12 is discharged in a flat horizontal position from an envelope inserting machine with one edge contacting the fixed registration guide 16. The adjustable registration guide 18 is adjusted to provide adequate clearance between the other edge of the envelope and the adjustable guide 18. The force with which the envelope is discharged from the inserter is sufficient to propel the envelope into the entrance nip 22.

Figure 5:
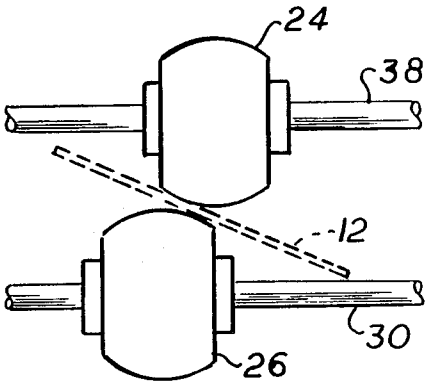
FIG. 5 is an end view taken from the entrance end with portions removed snowing an envelope being turned as it enters the entrance nip.

The position of the entrance rollers 24 and 26 help in turning the envelope 12 as soon as it enters the nip and contacts the belts 74 and 76. Referring to FIG. 5, it can be seen that the upper entrance roller 24 is mounted above and to one side of the lower entrance roller 26. This offset of the centers of the rollers with respect to each other results in a line of tangency between the two rollers to be in the plane of the envelope illustrated in FIG. 5. Thus the forces on the envelope 12 exerted by the belts 74 and 76 tend to immediately begin turning the envelope 12 as soon as it contacts them.

The belts 74, 76 are driven fast enough so that an envelope will be transported through the turning device and discharged before the succeeding envelope enters the entrance nip 22. In this manner only one envelope is being transported and turned at any given instant which minimizes the possibility of dropping an envelope due to too large a seperation of the belts.

The drive belts 74 and 76 are in frictional contact as they wrap around the upper entrance roller 24 and the lower entrance roller 26 respectively. As the belt 74 is driven, the belt 76 will in turn be driven at the same speed such that the contiguous portions of belts 74 and 76 will move together in the same direction. An envelope entering the entrance nip 22 will be grabbed by the belts and held between the contiguous portions of the drive and driven belts 74, 76. Thus the envelopes are turned 90 degrees with respect to their initial orientation and are discharged in a vertical position. The force with which the envelopes are discharged must be great enough to allow the envelopes to stack one behind the other in a discharge area 89 (FIG. 2). The roller 51 is driven at a speed sufficient to impart enough velocity to the discharging envelope to propel the envelope into the discharge area 89.

A segmented wheel 90 is positioned in the discharge area 89 to aid in stacking the envelopes vertically. One portion of the wheel 90 has a flat portion thereon. As the wheel 90 rotates in the direction of arrow C, it strikes the vertically oriented surface of the last discharged envelope. This assists in driving the envelope in the direction of movement and creates a pulsating force against the envelopes as they are stacked. It also pushes the envelopes away from the discharge area 89 and segmented wheel 90 and out along other conveyor means. In this manner the discharged envelopes 12 will be able to easily stack one behind the other in a continuous manner.

Figure 6:
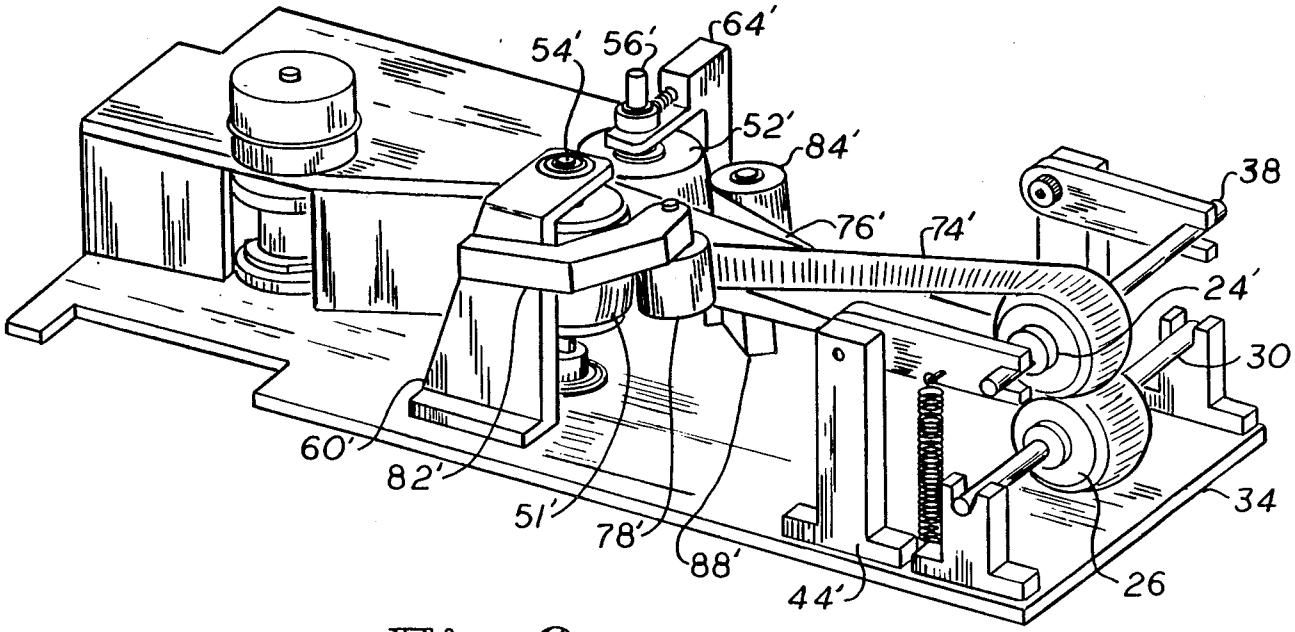
FIG. 6 is a perspective view from the entrance end of the turning device of an alternate embodiment used to turn articles in the direction opposite of the device illustrated in FIG. 1.

FIG. 6 illustrates an alternate embodiment in which the envelopes are turned counterclockwise when looking from the entrance end. This configuration may be necessary depending on the orientation of the documents as they enter the device 10 or depending on the apparatus processing the documents after the documents are discharged. Similar numbers have been used in FIG. 6 for ease in comparison with FIG. 1.

The entrance nip 22 has been slightly changed by mounting the upper entrance roller 24' above and to the side of the lower entrance roller 26 opposite the side that the upper entrance roller 24 is mounted in FIG. 5. This causes the envelopes 12 to begin turning in a counterclockwise direction. The exit nip 50 has also been changed by reversing the positions of the first and second exit rollers 51' and 52'. The first exit roller 51' is mounted on a shaft 54' and retained in bracket 60'. The second exit roller 52' is mounted on a shaft 56' and retained in bracket 64'. Movement of shaft 56' is permitted to accommodate documents of varying thickness, as previously described.

The idler roller 78' is mounted to an arm 82' affixed to the bracket 60'. Idler roller 84' has been moved from its position in the previous embodiment. It is now adjacent to the exit roller 52' rather than adjacent to the entrance roller 26. The drive belt 74' and driven belt 76' have been reversed and now are twisted 90 degrees from the entrance to the exit in the direction opposite the direction they were twisted in the previous embodiment. In this alternate embodiment, the repositioning of idler roller 84' was found to improve maintaining the belt on exit roller 52'. This configuration operates in all other ways substantially similar to the previously described embodiment.

Thus, there has been provided an article turning device that fully satisfies the objects, aims and advantages set forth above. It is evident that many alternatives, modifications, and variations will be apparent to those skilled in the art. Accordingly, it is intended to embrace all such variations as fall within the spirit and broad scope of the appended claims.

What is claimed is:

1. A device for turning articles such as envelopes or documents through 90 degrees about a conveying axis as the articles are moved forward from an entrance location to an exit location comprising:

two flexible endless belts each having at least one span contiguous to a corresponding span of the other, the contiguous spans moving in the same direction;

a pair of entrance rollers having contoured surfaces and mounted with respect to each other such that a line of tangency between the pair of entrance rollers forms an angle with respect to the plane of the articles as they enter the entrance location and causing the articles to begin turning in the direction of the line of tangency as they enter between the rollers;

a pair of exit rollers, with one of the flexible endless belts wrapped around one of the entrance and exit rollers and the other flexible endless belt wrapped around the other entrance and exit rollers, the belts adapted to convey and turn the article 90 degrees in the direction of movement from the entrance location to the exit location, the entrance and exit rollers having centrally disposed axes, the axes of the entrance rollers disposed horizontally and the axes of the exit rollers turned an angle of 90 degrees in the direction of the angular displacement of the article such that the axes of the exit rollers are vertically disposed;

means for guiding and maintaining the flexible endless belts wrapped around the entrance and exit rollers; and means for driving at least one of the rollers to move the contiguous belt spans together in the same direction from the entrance location to the exit location at the same rate of speed.

2. The device of claim 1 wherein the pair of entrance rollers comprise upper and lower spherical rollers mounted on respective upper and lower shafts, the upper spherical roller mounted above the lower spherical roller and to one side of a vertical plane passing through the center of the lower spherical roller and perpendicular to the lower shaft causing an article that enters between the upper and lower entrance rollers to begin turning in the direction of the line of tangency between the upper and lower rollers.

3. The device of claim 1 wherein the means for guiding and maintaining the flexible endless belts wrapped around the entrance and exit rollers comprises a first and second idler roller positioned between the entrance and exit rollers, each idler roller contacting and biasing one of the endless belts to assist in maintaining the belt in proper alignment with and wrapped around the roller which is adjacent to it.

4. The device of claim 3 wherein the first idler roller is positioned adjacent to one of the exit rollers and the second idler roller is positioned adjacent to one of the entrance rollers.

5. The device of claim 3 wherein the first and second idler rollers are positioned adjacent to the pair of exit rollers.

6. The device of claim 2 wherein the pair of exit rollers comprise first and second exit rollers, the first exit roller mounted on a first vertical shaft located on the same side of the vertical plane passing through the center of the lower spherical entrance roller as the upper entrance roller, and the second exit roller mounted on a second vertical shaft located on the side of the vertical plane opposite the first exit roller.

7. The device of claim 1 wherein the exit rollers are crowned rollers.

8. The device of claim 2 wherein the upper shaft is mounted on a pivotal linking arm, the center line of the pivotal linking arm forming an acute angle with the horizontal plane when no article is between the upper and lower rollers, and the center line lying in substantially the horizontal plane when an article is between the upper and lower rollers, the belts between the upper and lower rollers remaining in contact with each other when no article is present between them and further allowing the upper shaft to pivot away from the lower shaft to automatically accommodate articles of varying thickness.

9. The device of claim 2 and further comprising spring bias means for biasing the upper shaft towards the lower shaft.

10. The device of claim 6 wherein the second vertical shaft on which the second exit roller is mounted has spring means for allowing the second vertical shaft to be displaced from the first vertical shaft to automatically accommodate articles of varying thickness.

11. The device of claim 1 and further comprising registration guide means at the entrance location for contacting an edge of the articles being fed into the entrance rollers and properly positioning the articles for transport through the device.

12. An article turning device for transporting flat articles such as envelopes or documents from an entrance location to an exit location while simultaneously turning the articles, the device comprising:

an entrance nip defined by an upper entrance roller and a lower entrance roller, the rollers mounted at the entrance location on respective upper and lower shafts, the upper roller mounted above the lower roller and to one side of a vertical plane passing through the center of the lower roller and perpendicular to the lower shaft, causing an article that enters the nip to begin turning in the direction of a line of tangency between the upper and lower rollers;

an exit nip defined by a first and a second exit roller, the first exit roller mounted on a first vertical shaft located on one side of the vertical plane passing through the center of the lower entrance roller, and the second exit roller mounted on a second vertical shaft located on the other side of the vertical plane;

two flexible endless belts for transporting and turning articles longitudinally between them as the belts move contiguously from the entrance location to the exit location, the flexible endless belts respectively extending from the upper entrance roller to the first exit roller and from the lower entrance roller to the second exit roller; the belts being twisted 90 degrees between the entrance and exit rollers and each having at least one span contiguous to a corresponding span of the other, the spans traveling from the entrance rollers to the exit rollers;

means for driving at least one of the rollers so that the contiguous belt spans move together in the same direction from the entrance location to the exit location at the same rate of speed.

13. The device of claim 12 wherein the entrance and exit rollers are spherical rollers.

14. The device of claim 12 and further comprising a first idler roller positioned adjacent to the first exit roller and a second idler roller positioned adjacent to the lower entrance roller, each of the idler rollers in contact with one of the endless belts, the idler rollers assisting in maintaining the belt with which it is in contact in proper position around the roller which is adjacent to the idler roller.

15. The device of claim 12 and further comprising a first idler roller positioned adjacent to the first exit roller and a second idler roller positioned adjacent to the second exit roller, each of the idler rollers in contact with one of the endless belts, the idler rollers assisting in maintaining the belt with which it is in contact in proper position around the exit roller which is adjacent to it.

16. The device of claim 12 wherein the upper shaft is mounted on a pivotal linking arm, the center line of the pivotal linking arm forming an acute angle with the horizontal plane when no article is in the entrance nip, and the center line lying in substantially the horizontal plane when an article is in the nip thereby maintaining the belts in contact in the entrance nip when no article is present in the entrance nip, and further allowing the upper shaft to pivot away from the lower shaft to automatically accommodate articles of varying thickness.

17. The device of claim 16 and further comprising spring bias means for biasing the upper shaft towards the lower shaft.

18. The device of claim 12 wherein the second vertical shaft on which the second exit roller is mounted has spring means for allowing the second vertical shaft to be displaced from the first vertical shaft to automatically accommodate articles of varying thickness.

19. The device of claim 12 and further comprising registration guide means at the entrance location for contacting an edge of the articles being fed into the entrance nip and properly positioning the articles for transport through the device.

20. The device of claim 12 wherein the exit rollers are crowned rollers.

* * * * *